US006016122A

United States Patent [19]

Malone et al.

[11] Patent Number: 6,016,122

[45] Date of Patent: Jan. 18, 2000

[54] PHASED ARRAY ANTENNA USING PIEZOELECTRIC ACTUATORS IN VARIABLE CAPACITORS TO CONTROL PHASE SHIFTERS AND METHOD OF MANUFACTURE THEREOF

[75] Inventors: Hugh Robert Malone, Phoenix; Deborah Sue Dendy, Tempe; Dean Lawrence Cook, Mesa, all of Ariz.; James R. Phillips; Richard S. Kommrusch, both of Albuquerque, N.Mex.

[73] Assignee: Motorola, Inc., Schaumburg, Ill.

[21] Appl. No.: 09/088,197

[22] Filed: Jun. 1, 1998

[51] Int. Cl.[7] ..... H01P 1/18

[52] U.S. Cl. ..... 342/372; 333/159

[58] Field of Search ..... 342/371, 372, 342/368; 333/159

[56] References Cited

U.S. PATENT DOCUMENTS

| | | | |
|---|---|---|---|
| 3,166,723 | 1/1965 | Bock et al. | 333/10 |
| 4,127,834 | 11/1978 | Stringfellow et al. | 333/83 T |
| 4,238,662 | 12/1980 | Lao | 219/121 |
| 4,292,659 | 9/1981 | Lao | 361/283 |
| 4,380,747 | 4/1983 | Curtinot et al. | 333/202 |
| 5,504,466 | 4/1996 | Chan-Son-Lint et al. | 342/372 X |
| 5,543,765 | 8/1996 | Cachier | 333/246 |

*Primary Examiner*—Mark Hellner

*Attorney, Agent, or Firm*—James E. Klekotka; Walter W. Nielsen

[57] ABSTRACT

A phased array antenna (1000) is formed using a number of independently controllable piezoelectric phase shifters (1300) which results in a low cost phased array antenna that is functional at microwave and/or millimeter wave frequencies. In addition, the independently controllable piezoelectric phase shifters (1300) have sufficient phase range to allow a single antenna to be steered over a wide angle field of view. Piezoelectric phase shifters (1300) comprise at least one-voltage variable capacitor (1310, 1320, FIG. 2). Typically, the piezoelectric material used in the voltage variable capacitors is selected from a group consisting of lead-titanate ($PbTiO_3$), lead-zirconate ($PbZrO_3$), barium-titanate ($BaTiO_3$), and lead-zirconate-titanate ($PbZr_xTi_{1-x}O_3$), where x varies from zero to one.

27 Claims, 6 Drawing Sheets

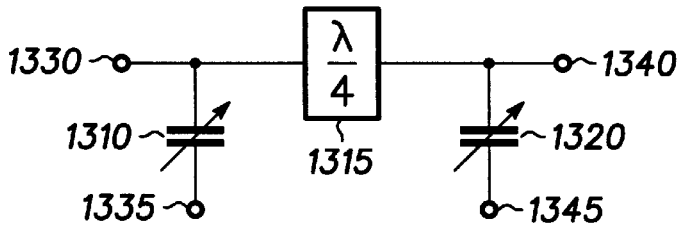
FIG. 2 1300
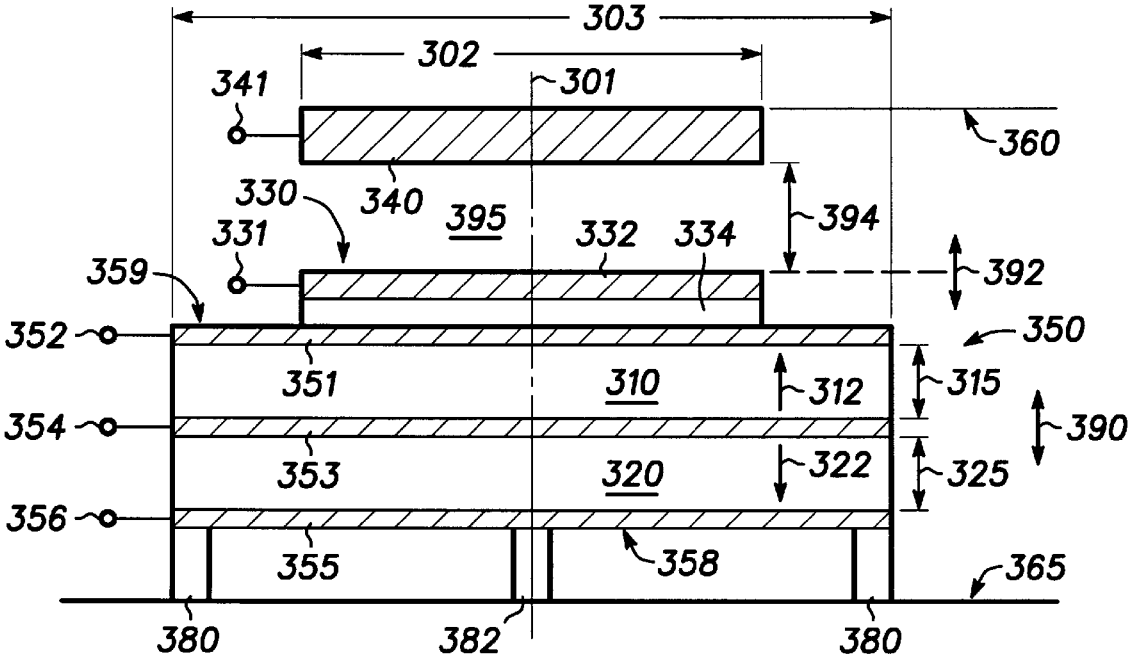
300 FIG. 3

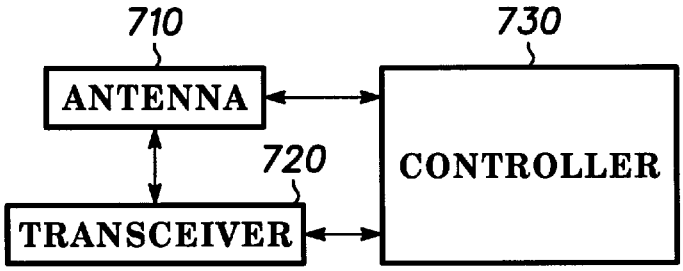
700 FIG. 7
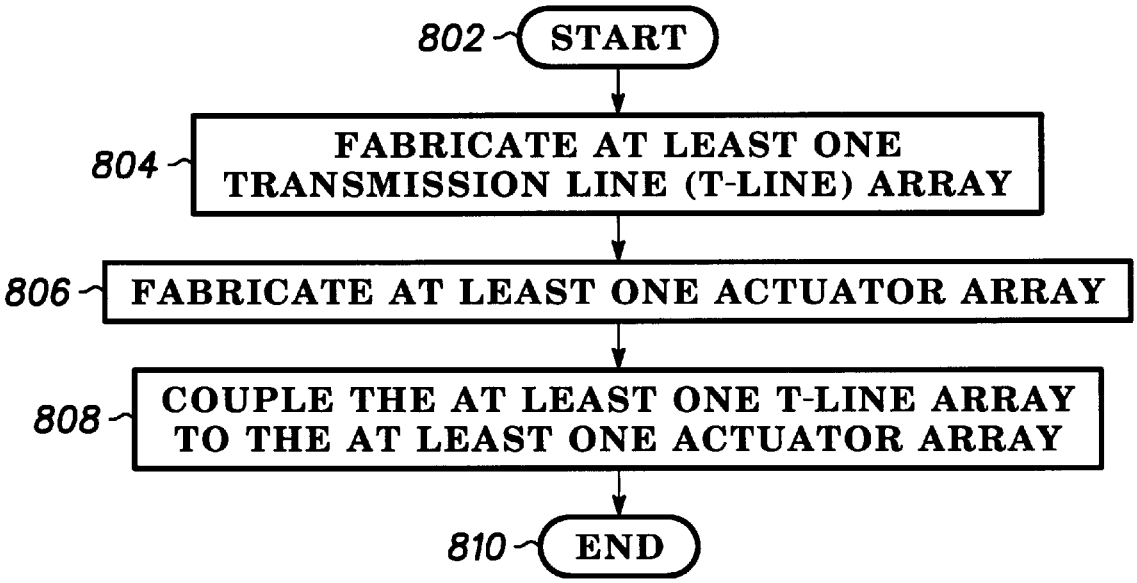
800
FIG. 8

PHASED ARRAY ANTENNA USING PIEZOELECTRIC ACTUATORS IN VARIABLE CAPACITORS TO CONTROL PHASE SHIFTERS AND METHOD OF MANUFACTURE THEREOF

CROSS-REFERENCE TO RELATED INVENTIONS

The present invention is related to the following inventions filed concurrently herewith and assigned to the same assignee as the present invention:

(1) U.S. patent Ser. No. 09/088,256, entitled "Voltage Variable Capacitor Array And Method Of Manufacture Thereof"; and (2) U.S. patent Ser. No. 09/088,255, entitled "Phased Array Antenna Using Piezoelectric Actuators To Control Waveguide Phase Shifters And Method Of Manufacture Thereof".

FIELD OF THE INVENTION

This invention relates generally to phased array antennas and, more particularly, to a phased array antenna with voltage variable capacitor arrays and a method of manufacture thereof.

BACKGROUND OF THE INVENTION

Present day and future Low Earth Orbit (LEO) satellite systems require low cost, high gain antennas for ground stations in order to meet system requirements. Because LEO satellites are moving with respect to a ground station and because of the high gain requirement for the antenna, the antenna needs to track the satellite. In addition, it is desirable for a ground station to track more than one satellite simultaneously in order to achieve a make before break hand-off from one satellite to another.

Conventional mechanical tracking high gain antennas are available that can acquire and track LEO satellites. However, mechanical antennas typically have moving parts, which can introduce reliability issues. In addition, a high profile is required to physically rotate the antenna in order to track the satellite. A high profile is undesirable in many residential installations. Typically, a mechanically pointed antenna can only track one satellite at a time, and this means two antennas have to be used, which compounds the size and reliability issues.

One potential solution to the limitations of a mechanical antenna is a phased array. Array antennas are well known in the art. In array antennas, multiple radiating/receiving elements are used to establish one or more beams. Phased array antennas have directional beams that can be steered in two different directions, typically azimuth and elevation.

Phased array antennas are constructed using multiple antenna elements, multiple phase shifters connected to the multiple antenna elements, and a distribution network connected to the phase shifters. In some applications, the phase shifters are the most critical components in an array antenna system. The phase shifter is required to produce a controllable amount of phase shift over the operating frequency band for the phased array antenna system.

Phase shifters have been constructed using a variety of techniques including ferrite materials and pin diode switches. Current methods for implementing phased shifters for phased array antennas are expensive and complex.

Accordingly, a need exists to provide a number of independently controllable phase shifters in a low cost phased array antenna that is functional at microwave and/or millimeter wave frequencies.

In particular, there is a significant need for a low cost single phased array antenna comprising a number of independently controllable phase shifters having sufficient phase range to allow the antenna to be steered over a wide field of view.

BRIEF DESCRIPTION OF THE DRAWINGS

A more complete understanding of the present invention can be derived by referring to the detailed description and claims when considered in connection with the figures, wherein like reference numbers refer to similar items throughout the figures, and:

FIG. 2 shows a simplified view of an electrical equivalent circuit for a piezoelectric phase shifter in accordance with a preferred embodiment of the invention;

FIG. 3 illustrates a simplified view of a voltage variable capacitor that uses a piezoelectric actuator in accordance with a preferred embodiment of the invention;

FIG. 7 shows a simplified block diagram of subscriber equipment, also known as customer premises equipment (CPE), in accordance with a preferred embodiment of the invention;

FIG. 8 illustrates a flowchart of a method for manufacturing a phased array antenna that is performed in accordance with a preferred embodiment of the present invention.

DETAILED DESCRIPTION OF A PREFERRED EMBODIMENT

The present invention provides a number of independently controllable piezoelectric phase shifters in a low cost phased array antenna that is functional at microwave and/or millimeter wave frequencies.

In addition, the present invention provides a low cost single phased array antenna comprising a number of independently controllable piezoelectric phase shifters having sufficient phase range to allow the antenna to be steered over a wide field of view. The present invention also provides a method of manufacturing such a phased array antenna.

The phased array antenna described in the present invention can be space-based or terrestrial-based. In a non-geostationary orbit, a space-based communication device and its associated antenna can move at high speed relative to any given point on the surface of the earth. The high relative speed between a moving device and a relatively stationary device means that the antenna has to dynamically alter the characteristics of its transmit and receive antenna beam patterns. Desirably, antenna beam patterns and pointing directions are varied over a wide-angle field of view.

Figure 1:
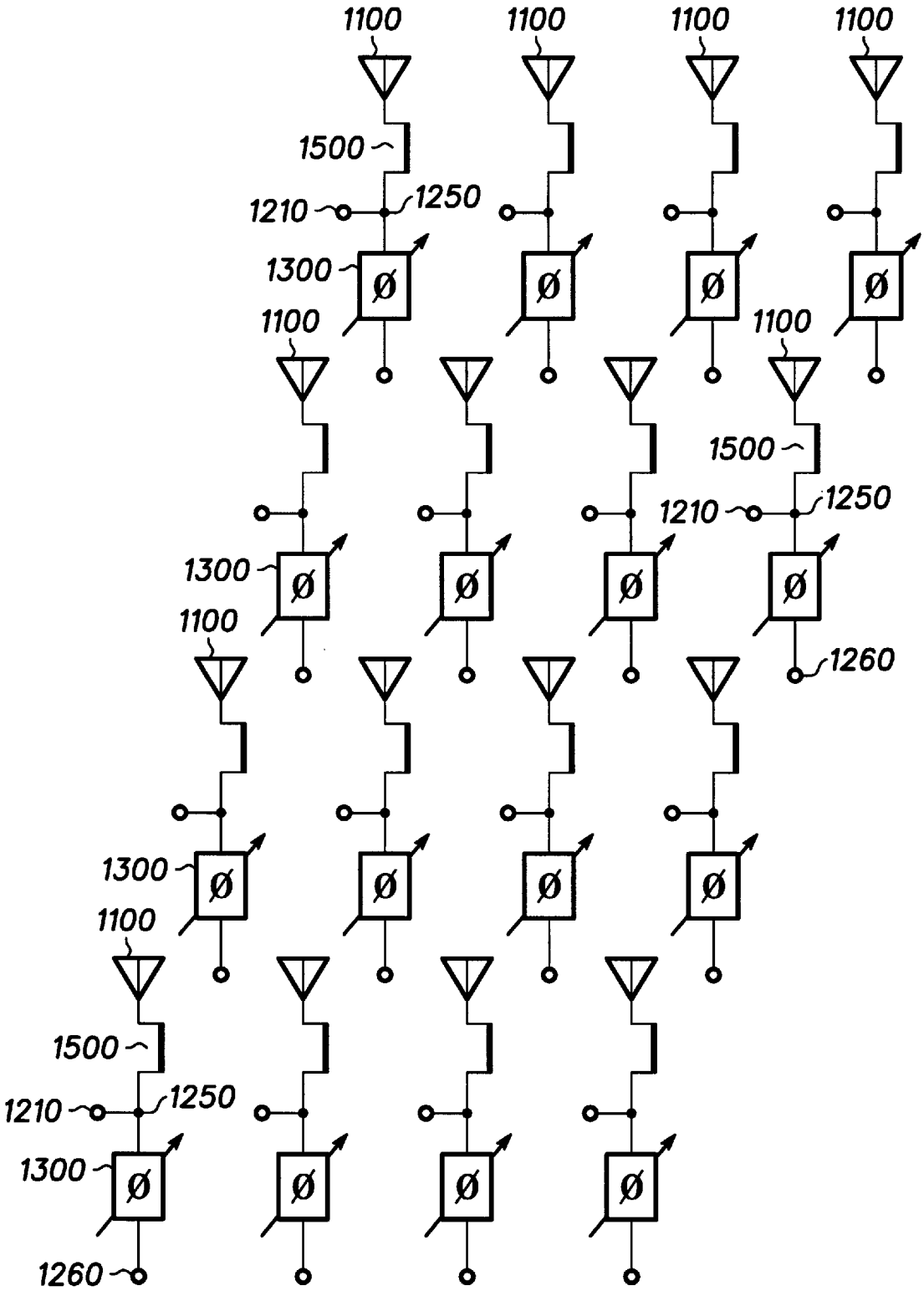
FIG. 1 shows a simplified view of an electrical equivalent circuit for a phased array antenna in accordance with a preferred embodiment of the invention.

FIG. 1 shows a simplified view of an electrical equivalent circuit for a phased array antenna in accordance with a preferred embodiment of the invention. In a preferred embodiment, antenna element 1100 is coupled to at least one T-line element 1500. Desirably, T-line element 1500 comprises at least two connection points, and T-line element 1500 is also coupled to at least one piezoelectric phase shifter 1300.

Desirably, phase shifter 1300 comprises two connection points, terminal 1250 and terminal 1260, and phase shifter 1300 is coupled to at least one distribution point 1210 using either terminal 1250 or terminal 1260. Distribution points 1210 are used to connect antenna elements to a distribution network (not shown). The distribution network is used to provide radio frequency (RF) energy to at least some of the antenna elements during a transmit operation, and it is used to combine RF energy received by at least some of the antenna elements during a receive operation. Distribution networks are well known to those skilled in the art.

In a preferred embodiment, phased array antenna 1000 is being used in a reflection mode. Phase shifter 1300 is coupled to at least one T-line element 1500 using terminal 1250, and phase shifter 1300 is also coupled to distribution point 1210 using terminal 1250. In addition, terminal 1260 on phase shifter 1300 is coupled through a low impedance path to ground.

In alternate embodiments, phased array antenna 1000 can be used in a transmission mode. In these embodiments, phase shifter 1300 can be coupled to at least one T-line element 1500 using terminal 1250, and phase shifter 1300 can be coupled to at least one distribution point 1210 using terminal 1260.

FIG. 2 shows a simplified view of an electrical equivalent circuit for a piezoelectric phase shifter in accordance with a preferred embodiment of the invention. Piezoelectric phase shifter 1300 comprises first variable capacitor 1310, T-line transformer 1315, second variable capacitor 1320, first connection terminal 1330, second connection terminal 1335, third connection terminal 1340, and fourth connection terminal 1345. Alternate embodiments can be envisioned which comprise different numbers of variable capacitors and different numbers of T-line transformers. In addition, other embodiments can be envisioned which comprise inductive elements.

In a preferred embodiment, one end of T-line transformer 1315 is coupled to one end of first variable capacitor 1310 and a first connection terminal 1330. Second connection terminal 1335 is connected to the other end of first variable capacitor 1310. The other end of T-line transformer 1315 is coupled to one end of second variable capacitor 1320 and a third connection terminal 1340. Fourth connection terminal 1345 is connected to the other end of second variable capacitor 1320. In alternate embodiments, different numbers of connection terminals could be used.

In a preferred embodiment, piezoelectric phase shifter 1300 provides a large phase shift range that allows the phased array antenna (1000, FIG. 1) to be steered over a wide field of view. In this embodiment, at least 180 degrees of phase shift is provided. In alternate embodiments, phased array antennas can be constructed using phase shifters that provide less than 180 degrees of phase shift. In addition, phased array antennas can be constructed using phase shifters that provide more than 180 degrees of phase shift.

In a preferred embodiment, voltage variable capacitors 1310, 1320 comprise at least one piezoelectric material. Desirably, the piezoelectric material is selected from a group consisting of lead-titanate ($PbTiO_3$), lead-zirconate ($PbZrO_3$), barium-titanate ($BaTiO_3$), and lead-zirconate-titanate ($PbZr_xTi_{1-x}O_3$), where x varies from zero to one. The subscripts (x and 1-x) are used to represent the molar amounts of lead-zirconate and lead-titanate, respectively.

In alternate embodiments, the piezoelectric material could be an electrically active polymer material. In these embodiments, the dimensional change with bias voltage of an electrically active polymer material can be 100 to 1000 times greater than the change for a conventional piezoelectric material.

In a preferred embodiment, T-line transformer 1315 comprises at least one quarter wavelength section of transmission line. Alternate embodiments can be envisioned which comprise different numbers of quarter wavelength sections of transmission line.

FIG. 3 illustrates a simplified view of a voltage variable capacitor that uses a piezoelectric actuator in accordance with a preferred embodiment of the invention. In a preferred embodiment, voltage variable capacitor 300 comprises first plate 330, second plate 340, and actuator 350. Also illustrated are reference surfaces 360, 365, and attachment devices 380, 382, although these are not required for the invention. For example, those skilled in the art will recognize that reference surfaces 360 and 365 may not be required in alternate embodiments. In a preferred embodiment, voltage variable capacitor 300 is used for capacitors 1310 and 1320 in piezoelectric phase shifter 1300.

Actuator 350 provides vertical movement as illustrated by double-headed arrow 390. Second plate 340 remains fixed, and first plate 330 moves relative to second plate 340. This movement is illustrated by double-headed arrow 392. First plate 330 is coupled to actuator 350. In this way, actuator movement as illustrated by double-headed arrow 390 is translated into plate movement as illustrated by double-headed arrow 392 and into gap size changes as illustrated by double-headed arrow 394.

Attachment devices 380, 382 are also illustrated in FIG. 3 as individual elements. This is done to simplify the explanation and understanding of the invention, and it is not intended to be limiting. In a preferred embodiment, attachment devices 380, 382 form a continuous surface.

Those skilled in the art will recognize that alternate embodiments can be envisioned which use a lever arm mechanism. In some of these embodiments, only one attachment device 380 is used. In some of these embodiments, first plate 330 and second plate 340 could be in offset positions relative to centerline 301.

Those skilled in the art will recognize that additional embodiments can be envisioned which use "oil-canning" mechanisms. In these embodiments, attachment device 382 is not used.

In a preferred embodiment, actuator 350 comprises a plurality of stacks that are coupled to each other. Desirably, a stacked configuration is used for actuator 350 to allow lower voltages to be used to achieve the same overall total displacement. In FIG. 3, actuator 350 is illustrated as comprising a single stack. This is done to simplify the explanation and understanding of the invention, and it is not intended to be limiting.

In a preferred embodiment, a stack comprises a first piezoelectric wafer 310, second piezoelectric wafer 320, first metallic layer 351, second metallic layer 353, and third metallic layer 355. In a preferred embodiment, first metallic layer 351 is coupled to a first surface of first piezoelectric wafer 310. In this embodiment, the first surface of first piezoelectric wafer 310 has been metalized using a well-known metalization technique. Terminal 352 is coupled to first metallic layer 351.

In a preferred embodiment, third metallic layer 355 is coupled to a second surface of second piezoelectric wafer 320. In this embodiment, the second surface of second piezoelectric wafer 320 has been metalized using a well-known metalization technique. Terminal 356 is coupled to third metallic layer 355.

In a preferred embodiment, second metallic layer 353 is coupled to a second surface of first piezoelectric wafer 310 and is coupled to a first surface of second piezoelectric wafer 320. In this embodiment, the second surface of first piezoelectric wafer 310 and the first surface of second piezoelectric wafer 320 have been metalized using a well-known metalization technique. The two metalized surfaces have been mated together to form second metallic layer 353.

In a preferred embodiment, terminal 354 is coupled to second metallic layer 353. In alternate embodiments, metallic layers 351, 353, 355 can be fabricated in a number of different ways. For example, metallic layers 351, 353, 355 can have a variety of sizes, shapes, and flexibility. In alternate embodiments, terminals 352, 354, 356 can be configured in a number of different ways.

In a preferred embodiment, first plate 330 comprises metallic layer 332 on separation layer 334, although this is not required for the invention. Those skilled in the art will recognize that alternate embodiments can be envisioned in which first plate 330 does not comprise separation layer 334. In alternate embodiments, first plate 330 could be included in actuator 350. In other alternate embodiments, first plate 330 could comprise a metallic sheet or plate.

In a preferred embodiment, first plate 330 is coupled to actuator 350. In this embodiment, separation layer 334 and metallic layer 332 are deposited on one end of actuator 350. In this embodiment, coupling is mechanical. Those skilled in the art will recognize that alternate embodiments can be envisioned in which different fabrication methods are used to form first plate 330 and couple it to actuator 350. In some of these embodiments, coupling can be both mechanical and electrical.

In a preferred embodiment, second plate 340 is coupled to second reference surface 360. In this embodiment, second reference surface 360 is one surface of a substrate, although this is not required for the invention. Those skilled in the art will recognize that reference surfaces are merely illustrated in FIG. 3 to provide reference points, which are used to explain how voltage variable capacitor 300 functions.

In a preferred embodiment, second plate 340 comprises a metallic layer that is deposited on second reference surface 360. Those skilled in the art will recognize that alternate embodiments can be envisioned in which different fabrication methods are used to form second plate 340. Those skilled in the art will also recognize that second plate 340 does not have to be coupled to second reference surface 360. For example, second plate 340 can be coupled to first plate 330 using a compliant material that allows the capacitor plates to move relative to each other.

Those skilled in the art will also recognize that second plate 340 does not have to comprise a metallic layer. In alternate embodiments, second plate 340 could comprise a metallic sheet or plate.

In a preferred embodiment, end 359 of actuator 350 is coupled to first plate 330. In addition, end 358 of actuator 350 is coupled to first reference surface 365. In this embodiment, first reference surface 365 is coupled to second reference surface 360. In this way, end 358 is fixed, and end 358 is not allowed to move relative to reference surfaces 360, 365. Those skilled in the art will recognize that alternate embodiments can be envisioned in which a number of different attachment devices, as illustrated by 380 and 382, can be used, and these embodiments are within the scope of the invention.

In a preferred embodiment, spacing 395 is provided to allow movement as illustrated by double-headed arrow 394 to occur between first plate 330 and second plate 340. In this way, a parallel plate capacitor is formed in which the amount of capacitance is controlled by, among other things, the size of spacing 395.

In a preferred embodiment, first plate 330 and second plate 340 have equal lengths 302, and equal widths (not shown). This is not required for the invention. Those skilled in the art will recognize that first plate 330 and second plate 340 can have different dimensions in alternate embodiments.

In a preferred embodiment, first piezoelectric wafer 310 has length 303, thickness 315, and polarity 312. In this embodiment, second piezoelectric wafer 320 has length 303, thickness 325, and polarity 322. In a preferred embodiment, length 303, thickness 315 and thickness 325 are determined using known displacement equations to provide the required amount of movement as illustrated by double-headed arrow 390 and related movement as illustrated by double-headed arrow 394. In this embodiment, movement as illustrated by double-headed arrow 390 occurs due to changes in thickness 315 and thickness 325.

In a preferred embodiment, polarity 312 is established using a first poling voltage, and polarity 322 is established using a second poling voltage. In this embodiment, two separate piezoelectric wafers are metalized, and they are poled in the thickness expansion mode.

Ceramic materials are often not piezoelectric until their random ferroelectric domains are aligned. This alignment is accomplished through a process known as "poling". Poling includes inducing a DC voltage across the material. The ferroelectric domains align to the induced field, resulting in a net piezoelectric effect. It should be noted that not all the domains become exactly aligned. Some of the domains only partially align and some do not align at all. The number of domains that align depends upon the poling voltage, temperature, crystal structure, and the time the voltage is held on the material.

During poling the material permanently increases in the dimension between the poling electrodes and decreases in a dimension parallel to the electrodes. The material can be de-poled by reversing the poling voltage, increasing the temperature beyond the material's Curie point, or by inducing a large mechanical stress in the opposite direction of polarity.

Voltage applied to the electrodes at the same polarity as the original poling voltage results in a further increase in the dimension between the electrodes and results in a decrease in the dimension parallel to the electrodes. Applying a voltage to the electrodes in an opposite direction decreases the dimension between the electrodes and increases the dimension parallel to the electrodes.

In a preferred embodiment, first piezoelectric wafer 310 and second piezoelectric wafer 320 are bonded together such that polarity 312 and polarity 322 are aligned in opposite directions.

In a preferred embodiment, terminals 352 and 356 are connected together to form a first connection point, and terminal 354 is used as a second connection point. In this embodiment, a voltage can be applied between the first connection point and the second connection point. In this way, a field is established either across both wafers that is in the same direction as the poling voltage or in the opposite direction as the poling voltage.

Desirably, both wafers increase in thickness and decrease in length in one case, and both wafers decrease in thickness and increase in length in the other case. Consequently, the overall thickness of actuator 350 changes. By fixing one end 358, the changes in thickness are translated into vertical movement illustrated by double-headed arrows 390, 392, and 394.

In a preferred embodiment, the magnitude and polarity of the field applied between the first connection point and the second connection point are changed to control vertical movement as illustrated by double-headed arrow 394. In this way, the amount of capacitance provided by voltage variable capacitor 300 is controlled. By controlling the amount of capacitance in voltage variable capacitor 300, the amount of phase shift in piezoelectric phase shifter 1300 (FIG. 2) can be controlled.

In a preferred embodiment, actuator 350 is coupled to reference surface 365. Alternate embodiments can be envisioned in which actuator 350 is not coupled to reference surface 365. For example, actuator 350 can be coupled to a reference surface that is perpendicular to reference surface 365.

In alternate embodiments, second plate 340 is dielectrically coupled to first plate 330 using air or another gas as the dielectric coupling material. Those skilled in the art will recognize that a number of different coupling mechanisms could be used. For example, a piece of dielectric material could be used with or without air.

In an alternate embodiment, an isolation layer can be provided between first plate 330 and second plate 340. In this embodiment, the isolation layer prevents first plate 330 from coming in contact with second plate 340. For example, allowing first plate 330 and second plate 340 to contact each other causes an electrical short, and this is not desirable in many applications.

In a preferred embodiment, connection terminal 331 is coupled to first plate 330, and connection terminal 341 is coupled to second plate 340. In this embodiment, connection terminals 331 and 341 are used to couple capacitor 300 to, among other things, T-line transformer 1315 (FIG. 2) and T-line element 1500 (FIG. 1).

In a preferred embodiment, wafers 310, 320 are substantially the same size, although this is not required for the invention. In this embodiment, wafers 310, 320 have substantially the same width, substantially the same length, and substantially the same thickness. Those skilled in the art will recognize that wafers 310, 320 having different dimensions can be used in alternate embodiments.

In a preferred embodiment, when an actuator is formed, alternate metallic layers are electrically coupled. In this embodiment, metallic layers can be at odd or even counting positions when a stacked configuration is used in the actuator. Metallic layers having an odd count are connected to a first connection point, and metallic layers having an even count are connected to a second connection point. In this manner, a piezoelectric material layer (wafer) has an odd numbered metallic layer on one end and an even numbered metallic layer on the opposite end. A voltage difference is established across each piezoelectric material layer. This voltage difference causes a change in the thickness of the piezoelectric material layer. In this embodiment, the thickness is the dimension between the metallic layers.

In a preferred embodiment, the piezoelectric material is selected from a group consisting of lead-titanate ($PbTiO_3$), lead-zirconate ($PbZrO_3$), barium-titanate ($BaTiO_3$), and lead-zirconate-titanate ($PbZr_xTi_{1-x}O_3$), where x varies from zero to one. The subscripts (x and 1-x) are used to represent the molar amounts of lead-zirconate and lead-titanate, respectively.

In alternate embodiments, the piezoelectric material could be an electrically active polymer material. In these embodiments, the dimensional change with bias voltage of an electrically active polymer material can be 100 to 1000 times greater than the change for a conventional piezoelectric material.

Figure 4:
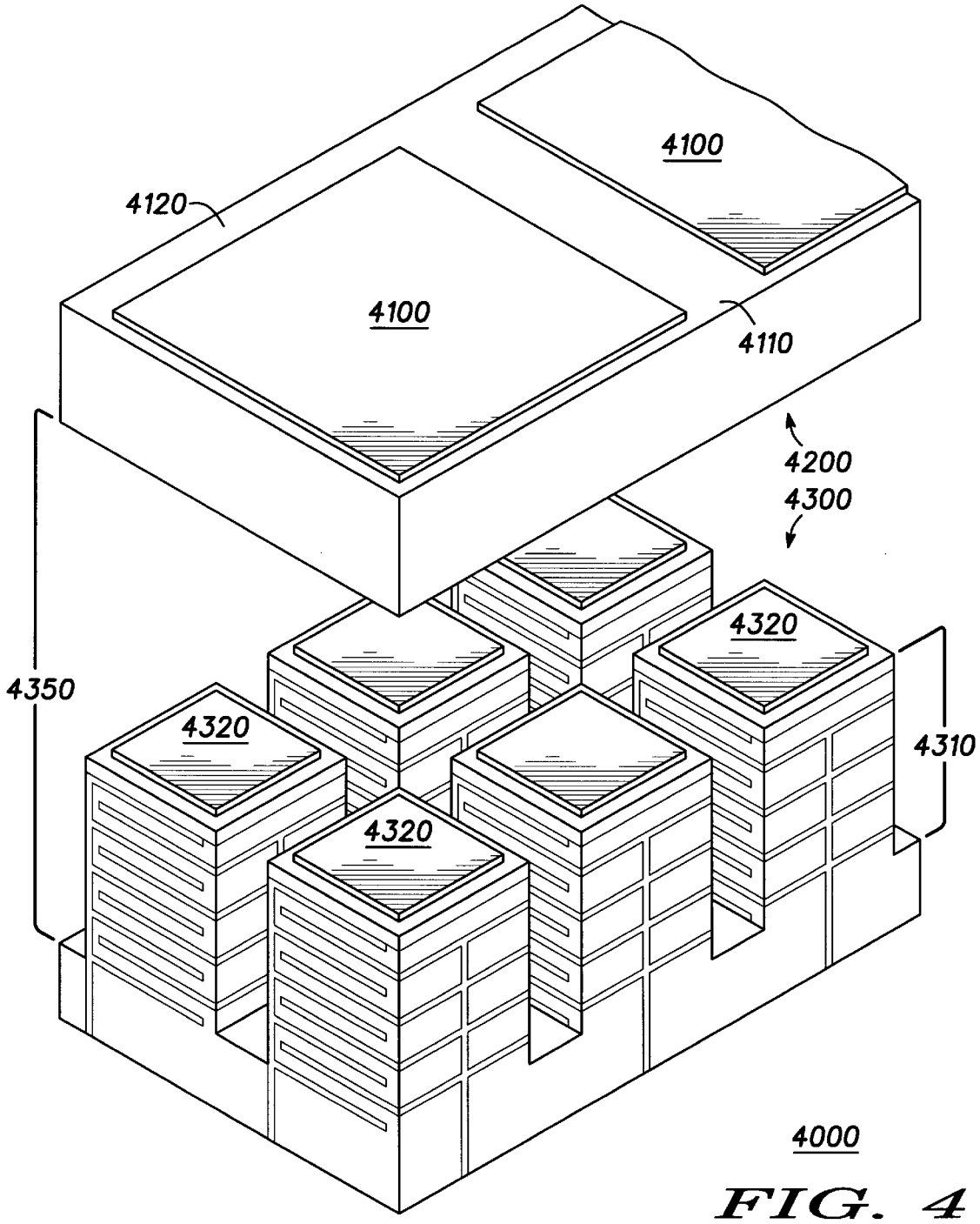
FIG. 4 shows an exploded view of a phased array antenna comprising an array of piezoelectric phase shifters in accordance with a preferred embodiment of the invention.

FIG. 4 shows an exploded view of a phased array antenna comprising an array of piezoelectric phase shifters in accordance with a preferred embodiment of the invention. Phased array antenna 4000 comprises a plurality of antenna elements 4100 arranged in an I by J format, at least one T-line array 4200, and an array 4300 of voltage variable capacitors 4350 arranged in a K by L format, where I, J, K, and L are positive integers. Voltage variable capacitor 4350 comprises a top plate 4330 (shown in FIG. 5), a bottom plate 4320, and at least one actuator 4310. Those skilled in the art will recognize that the I by J format for antenna elements 4100 can be equal to or different from the K by L format for voltage variable capacitors 4350.

In a preferred embodiment, a reflective type phased array is illustrated, although this is not required for the invention. In alternate embodiments, piezoelectric phase shifters can be used in both reflective and transmission types of phased array antennas.

In a preferred embodiment, each antenna element 4100 is coupled to at least one voltage variable capacitor 4350 in array 4300. Coupling is provided by T-line structures, such as illustrated by T-line elements 1500 (FIG. 1), in T-line array 4200.

In a preferred embodiment, antenna elements 4100 comprise at least one metallic layer. In this embodiment, antenna elements 4100 are deposited on a first surface of T-line array 4200.

In FIG. 4, antenna elements 4100 are illustrated using a square shape, although this is not required for the invention. Alternate embodiments can be envisioned that comprise antenna elements with different shapes.

In a preferred embodiment, antenna elements 4100 are separated by horizontal spacing 4110 and vertical spacing 4120. Desirably, horizontal spacing 4110 and vertical spacing 4120 are less than a quarter wavelength.

In a preferred embodiment, antenna elements 4100 are desirably a quarter wavelength in width and length, although this is not required for the invention. Alternate embodiments could use antenna elements having a number of different sizes.

Figure 5:
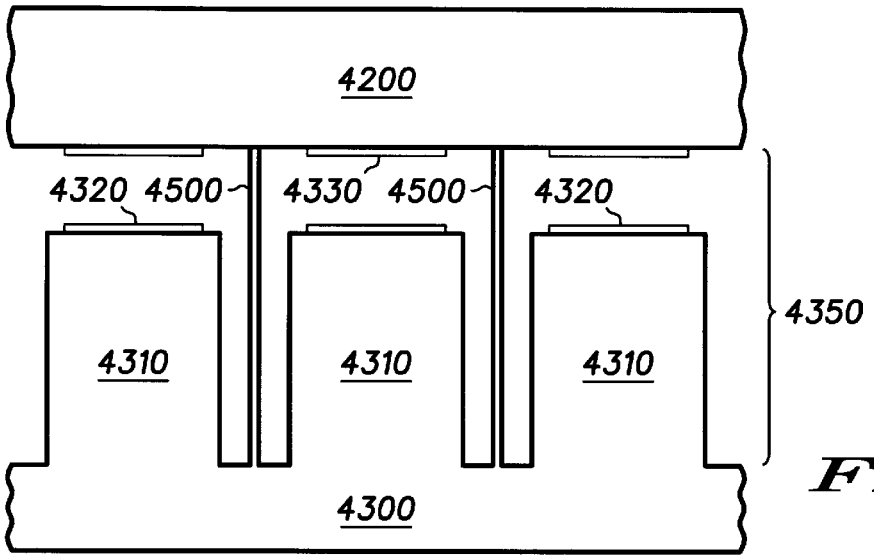
FIG. 5 shows a side view of a phased array antenna comprising an array of piezoelectric phase shifters in accordance with a preferred embodiment of the invention.

FIG. 5 shows a side view of a phased array antenna comprising an array of piezoelectric phase shifters in accordance with a preferred embodiment of the invention.

In a preferred embodiment of the present invention, voltage variable capacitors 4350 do not touch each other. Small gaps are present between actuators 4310 and capacitors 4350. In alternate embodiments, these gaps can vary in size and shape.

In a preferred embodiment, support structures 4500 are provided to separate T-line array 4200 from array 4300. In alternate embodiments, different fabrication techniques can be used. In some embodiments, support structures 4500 are not used. In some embodiments, support structures 4500 are used to attach T-line array 4200 to array 4300.

Figure 6:
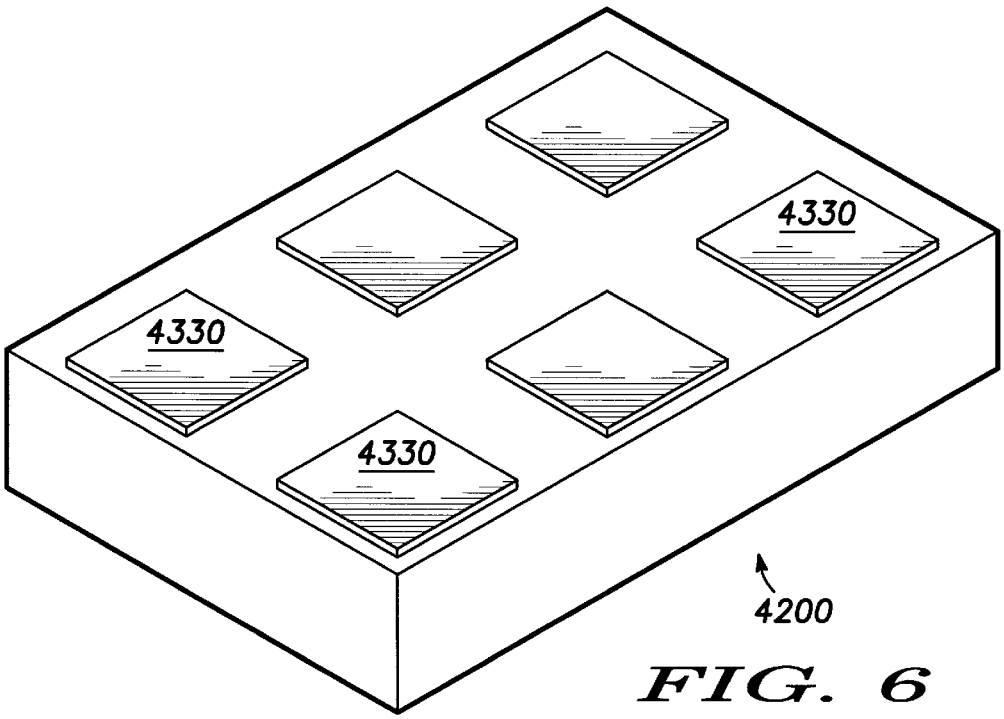
FIG. 6 shows a simplified view of the bottom side of a transmission-line (T-line) array in accordance with a preferred embodiment of the invention.

FIG. 6 shows a simplified view of the bottom side of a T-line array in accordance with a preferred embodiment of the invention. In a preferred embodiment, a single metallic layer is used for top plate 4330 (second plate 330, FIG. 3) in voltage variable capacitor 4350.

In alternate embodiments, top plate 4330 can comprise two or more individual segments. In some embodiments, sensor circuitry can be connected to at least one of the segments. In some embodiments, control circuitry can be connected to at least one of the segments.

A phased array antenna using piezoelectric phase shifters has advantages over conventional fixed beam antennas because it can, among other things, provide greater viewing angles, adaptively adjust antenna beam patterns, and provide multiple antenna beams in response to demand for communication services. These features could be implemented through appropriate software procedures performed in a controller (shown in FIG. 7).

In alternate embodiments of the invention, actuators (4310, FIG. 4) can have different shapes than those illustrated in FIG. 4. For example, individual array elements can be any polygonal shape. Circles and/or ellipses can also be used. In other alternate embodiments, the number of voltage variable capacitors 4350 can be changed. For example, a simple antenna can comprise a single voltage variable capacitor 4350, and this single voltage variable capacitor 4350 can have a variety of shapes.

FIG. 7 shows a simplified block diagram of subscriber equipment, also known as customer premises equipment (CPE), in accordance with a preferred embodiment of the invention. CPE 700 comprises phased array antenna 710, transceiver 720, and controller 730. Phased array antenna 710 is coupled to transceiver 720. Controller 730 is coupled to phased array antenna 710 and transceiver 720.

In a preferred embodiment, phased array antenna 710 comprises at least one phased array antenna 4000 (FIG. 4). In this embodiment, controller 730 is used to provide, among other things, the control voltages to voltage variable capacitors 4350 (FIG. 4).

Typically, CPE 700 is mounted on a rooftop or similar location at a subscriber's residence or place of business. In many cases, cost and viewing angle are significant factors for a commercially successful CPE 700. This means that there is a significant need for a low cost phased array antenna as provided by phased array antenna 4000 (FIG. 4). Desirably, a phased array antenna in CPE 700 is steered over a wide field of view as provided by phased array antenna 4000 (FIG. 4).

The method and apparatus of the present invention enable a phased array antenna in a communication device, such as CPE 700 illustrated in FIG. 7, to adaptively change antenna radiation patterns. This is accomplished in both transmit mode and receive mode.

FIG. 8 illustrates a flowchart of a method for manufacturing a phased array antenna that is performed in accordance with a preferred embodiment of the present invention. Procedure 800 starts in step 802.

In step 804, at least one T-line array is fabricated. Desirably, a T-line array comprises a plurality of antenna elements on a first surface of the T-line array, at least one ground plane surface in the T-line array, a plurality of T-line elements, a plurality of T-line transformers, and a plurality of second plates on a second surface of the T-line array.

In a preferred embodiment, a T-line array is fabricated by depositing a plurality of antenna elements on a first surface using at least one metal. Desirably, the plurality of antenna elements is configured as an I by J array, where I and J are positive integers. Next, a plurality of second plates is deposited on a second surface of the T-line array using at least one metal. Desirably, the plurality of second plates is configured as a K by L array, where K and L are positive integers. Then, the plurality of antenna elements is coupled to the plurality of second plates using a plurality of T-line elements.

In step 806, at least one actuator array is fabricated. Desirably, an actuator array comprises a plurality of first plates coupled to a plurality of piezoelectric actuators. In a preferred embodiment, the plurality of piezoelectric actuators is coupled to at least one reference surface.

In step 808, each T-line array is coupled to an actuator array using at least one support structure 4500. Desirably, at least one dielectric material is used between the plurality of first plates and the plurality of second plates.

In a preferred embodiment, voltage variable capacitors, such as illustrated by voltage variable capacitor 1310 and 1320 (FIG. 2), are formed. In addition, piezoelectric phase shifters, as illustrated by piezoelectric phase shifter 1300 (FIG. 2), are also formed. Desirably, the voltage variable capacitors, among other things, control the phase shift in the plurality of piezoelectric phase shifters.

Procedure 800 ends in step 810.

Figure 9:
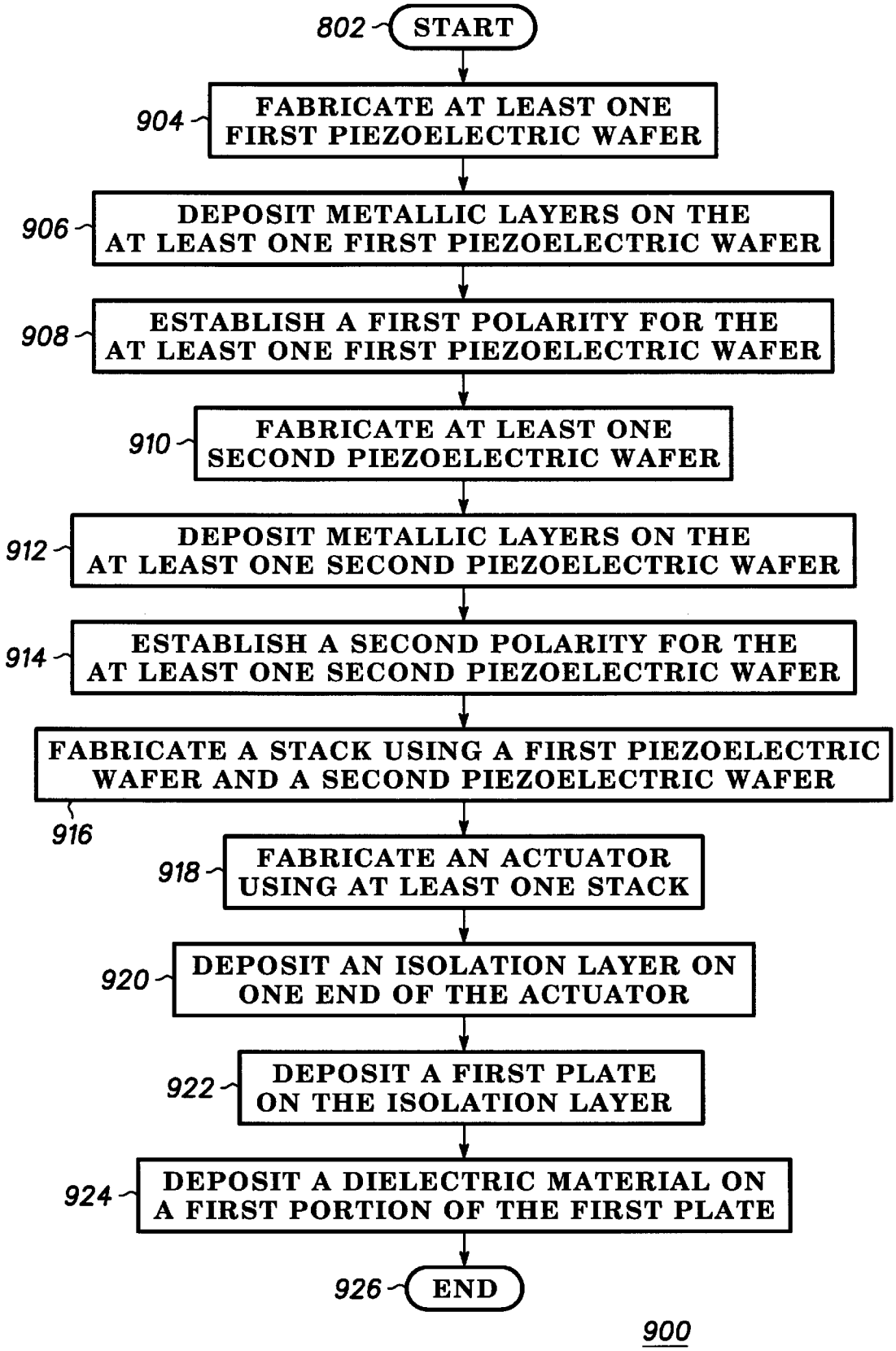
FIG. 9 illustrates a flowchart of a method for manufacturing an actuator array that is performed in accordance with a preferred embodiment of the present invention.

FIG. 9 illustrates a flowchart of a method for manufacturing an actuator array that is performed in accordance with a preferred embodiment of the present invention. Procedure 900 starts in step 902. Using this procedure, piezoelectric actuators are fabricated, and they are configured in the actuator array as a K by L array, where K and L are positive integers. Desirably, a piezoelectric actuator comprises at least one stack, and a stack comprises a first piezoelectric wafer and a second piezoelectric wafer.

In step 904, at least one first piezoelectric wafer is fabricated. Desirably, a first piezoelectric wafer has a first length, a first thickness, and a first width. The first thickness is the distance between a first surface and a second surface on the first piezoelectric wafer.

In step 906, metallic layers are deposited on the first surface and the second surface of the first piezoelectric wafer. Desirably, a metallic layer is deposited on the first surface using at least one metal. In addition, another metallic layer is deposited on the second surface using at least one metal.

In step 908, a first polarity is established for the first piezoelectric wafers using a first poling voltage. The first poling voltage is applied across the first piezoelectric wafers using the metallic layers.

In step 910, at least one second piezoelectric wafer is fabricated. Desirably, a second piezoelectric wafer has a second length, a second thickness, and a second width. The second thickness is the distance between a first surface and a second surface on the second piezoelectric wafer.

In step 912, metallic layers are deposited on the first surface and the second surface of the second piezoelectric wafer. Desirably, a metallic layer is deposited on the first surface using at least one metal. In addition, another metallic layer is deposited on the second surface using at least one metal.

In step 914, a second polarity is established for the second piezoelectric wafers using a second poling voltage. The second poling voltage is applied across the second piezoelectric wafers using the metallic layers.

In step 916, a stack is fabricated by mating a first piezoelectric wafer to a second piezoelectric wafer so that the first polarity and the second polarity are aligned in opposite directions. In alternate embodiments, the stack is fabricated by mating the first piezoelectric wafer to the second piezoelectric wafer so that the first polarity and the second polarity are aligned in the same direction.

In step 918, the K by L array of actuators is created using at least one stack to create each actuator. In a preferred embodiment, connection points are established for each piezoelectric actuator. Desirably, when a positive voltage is applied from a first connection point to a second connection point, the overall length of the actuator increases. This causes the first plate to move closer to the second plate, causing the amount of capacitance to increase. In addition, when a negative voltage is applied from a first connection point to a second connection point, the overall length of the actuator decreases. This causes the first plate to move away from the second plate, causing the amount of capacitance to decrease. Those skilled in the art will recognize that the effects caused by the negative and positive voltages can be different in alternate embodiments.

In a preferred embodiment, these capacitance changes cause changes in the amount of phase shift provided by the piezoelectric phase shifters. This allows the phased array antenna to be controlled.

In step 920, an isolation layer is deposited on each actuator in the K by L array. In step 922, at least one first plate is deposited on each isolation layer using at least one metal. In step 924, a dielectric material is deposited on at least some of the first plates. This is done to, among other things, facilitate the coupling of the T-line array to the actuator array and is not required for the invention. Procedure 900 ends in step 926.

The present invention has been described above with reference to a preferred method of manufacture. However, those skilled in the art will recognize that alternate methods can be used without departing from the scope of the present invention. For example, an actuator array could be manufactured as a single multilayer component or a single piezoelectric element, and individual actuators could be fabricated using a material removal process.

The present invention has also been described above with reference to a preferred embodiment. However, those skilled in the art will recognize that changes and modifications can be made in this embodiment without departing from the scope of the present invention. For example, while a preferred embodiment has been described in terms of using a specific implementation for the voltage variable capacitors, other systems can be envisioned which use different implementations. Accordingly, these and other changes and modifications, which are obvious to those skilled in the art, are intended to be included within the scope of the invention.

What is claimed is:

1. A phased array antenna comprising:

a plurality of transmission line (T-line) arrays, wherein said plurality of T-line arrays comprises a plurality of antenna elements deposited on a first surface of said plurality of T-line arrays, at least one ground plane surface fabricated within at least one of said plurality of T-line arrays, a plurality of second plates deposited on a second surface of said plurality of T-line arrays, and a plurality of T-lines, wherein said plurality of antenna elements is coupled to said plurality of second plates using at least one of said plurality of T-lines;

a distribution network coupled to at least one of said plurality of T-line arrays; and a plurality of actuator arrays coupled to said plurality of T-line arrays, said plurality of actuator arrays comprising a plurality of first plates coupled to a plurality of piezoelectric actuators, said plurality of piezoelectric actuators being coupled to a plurality of reference surfaces, said plurality of first plates being coupled to said plurality of second plates using at least one dielectric material, wherein a first amount of capacitance is established between a first plate and a second plate, said first amount of capacitance causing a first amount of phase shift, wherein said plurality of antenna elements is configured into at least one I by J array, said plurality of first plates and said plurality of second plates are configured into at least one K by L array of voltage variable capacitors, wherein I, J, K, and L are positive integers, and wherein a voltage variable capacitor comprises at least one first plate, at least one second plate, and at least one piezoelectric actuator.

2. The phased array antenna as claimed in claim 1, wherein said at least one piezoelectric actuator further comprises at least one stack, wherein a stack comprises:

a first piezoelectric wafer having a first length, a first thickness, a first width, a first polarity, a first surface, a second surface, a first end, said first thickness being a distance between said first surface and said second surface, said first length being a distance from said first end, said first piezoelectric wafer being coupled to one of said plurality of reference surfaces at said first end;

a second piezoelectric wafer having a second length, a second thickness, a second width, a second polarity, a first surface, a second surface, a first end, said second thickness being a distance between said first surface and said second surface, said second length being a distance from said first end, said second piezoelectric wafer being coupled to said one of said plurality of reference surfaces at said first end;

a first metallic layer coupled to said first surface of said first piezoelectric wafer and coupled to said first plate;

a second metallic layer coupled to said second surface of said first piezoelectric wafer and coupled to said first surface of said second piezoelectric wafer; and a third metallic layer coupled to said second surface of said second piezoelectric wafer.

3. The phased array antenna as claimed in claim 1, wherein said at least one piezoelectric actuator further comprises at least one stack, wherein a stack comprises:

a first piezoelectric wafer having a first length, a first thickness, a first width, a first polarity, a first surface, a second surface, a first end, said first thickness being a distance between said first surface and said second surface, said first length being a distance from said first end;

a second piezoelectric wafer having a second length, a second thickness, a second width, a second polarity, a first surface, a second surface, a first end, said second thickness being a distance between said first surface and said second surface, said second length being a distance from said first end;

a first metallic layer coupled to said first surface of said first piezoelectric wafer and coupled to said first plate;

a second metallic layer coupled to said second surface of said first piezoelectric wafer and coupled to said first surface of said second piezoelectric wafer; and a third metallic layer coupled to said second surface of said second piezoelectric wafer and coupled to one of said plurality of reference surfaces.

4. The phased array antenna as claimed in claim 3, wherein said at least one piezoelectric actuator further comprises:

at least one isolation layer between said first plate and said first metallic layer.

5. The phased array antenna as claimed in claim 3, wherein said at least one piezoelectric actuator further comprises:

at least one isolation layer between said first plate and said second plate.

6. The phased array antenna as claimed in claim 3, wherein said at least one dielectric material comprises a compliant dielectric material.

7. The phased array antenna as claimed in claim 3, wherein said at least one piezoelectric actuator further comprises:

a first terminal coupled to said first metallic layer and said third metallic layer; and a second terminal coupled to said second metallic layer.

8. The phased array antenna as recited in claim 3, wherein said first polarity is established by poling said first piezoelectric wafer in a thickness expansion mode using a first poling voltage and said second polarity is established by poling said second piezoelectric wafer in a thickness expansion mode using a second poling voltage.

9. The phased array antenna as recited in claim 3, wherein said first polarity and said second polarity are aligned in the same direction.

10. The phased array antenna as recited in claim 3, wherein said first polarity and said second polarity are aligned in opposite directions.

11. The phased array antenna as recited in claim 3, wherein said first piezoelectric wafer further comprises at least one material selected from a group consisting of lead-titanate ($PbTiO_3$), lead-zirconate ($PbZrO_3$), barium-titanate ($BaTiO_3$), and lead-zirconate-titanate ($PbZr_xTi_{1-x}O_3$), where x varies from zero to one.

12. The phased array antenna as recited in claim 3, wherein said second piezoelectric wafer further comprises at least one material selected from a group consisting of lead-titanate ($PbTiO_3$), lead-zirconate ($PbZrO_3$), barium-titanate ($BaTiO_3$), and lead-zirconate-titanate ($PbZr_xTi_{1-x}O_3$), where x varies from zero to one.

13. The phased array antenna as recited in claim 3, wherein said first piezoelectric wafer further comprises at least one electrically active polymer.

14. The phased array antenna as recited in claim 3, wherein said second piezoelectric wafer further comprises at least one electrically active polymer.

15. The phased array antenna as claimed in claim 1 wherein said plurality of T-line arrays further comprises a plurality of third plates deposited on said second surface of said plurality of T-line arrays, wherein a second amount of capacitance is established between said first plate and a third plate.

16. The phased array antenna as claimed in claim 15, wherein said plurality of T-line arrays further comprises:

at least one control network coupled to at least one of said plurality of third plates, said at least one control network for monitoring said second amount of capacitance.

17. The phased array antenna as claimed in claim 1, wherein said plurality of T-line arrays further comprises:

a plurality of second connection terminals coupled to said plurality of second plates.

18. The phased array antenna as claimed in claim 1, wherein said plurality of actuator arrays further comprises:

a plurality of first connection terminals coupled to said plurality of first plates.

19. The phased array antenna as claimed in claim 1, wherein said plurality of T-line arrays further comprises:

a plurality of T-line transformers, wherein a T-line transformer is coupled to at least two of said plurality of second plates and to a ground plane surface.

20. The phased array antenna as claimed in claim 19, wherein at least one of said plurality of T-line transformers is coupled to at least one of said plurality of antenna elements.

21. A method for manufacturing a phased array antenna, said method comprising the steps of:

a) fabricating at least one transmission line (T-line) array, a T-line array comprising a plurality of antenna elements on a first surface of said T-line array, at least one ground plane surface in said T-line array, and a plurality of second plates on a second surface of said T-line array, wherein said step a) further comprises the steps of:

a1) depositing said plurality of antenna elements on said first surface using at least one metal, said plurality of antenna elements being configured as an I by J array, wherein I and J are positive integers;

a2) depositing said plurality of second plates on said second surface of said T-line array using at least one metal, said plurality of second plates being configured as a K by L array, wherein K and L are positive integers; and a3) coupling said plurality of antenna elements to said plurality of second plates using a plurality of T-line elements;

b) fabricating at least one actuator array, an actuator array comprising a plurality of first plates coupled to a plurality of piezoelectric actuators, said plurality of piezoelectric actuators being coupled to at least one reference surface; and c) coupling said T-line array to said actuator array using at least one dielectric material, whereby a first amount of capacitance is established between a first plate and a second plate, said first amount of capacitance causing a first amount of phase shift.

22. The method as recited in claim 21, wherein said step b) further comprises the steps of:

b1) fabricating said plurality of piezoelectric actuators as a K by L array, wherein K and L are positive integers, and wherein a piezoelectric actuator comprises at least one stack, a stack comprising a first piezoelectric wafer and a second piezoelectric wafer;

b2) depositing an isolation layer on at least one actuator in said K by L array; and b3) depositing at least one of said plurality of first plates on at least one isolation layer using at least one metal.

23. The method as recited in claim 22, wherein said step b1) further comprises the steps of:

b1a) fabricating said first piezoelectric wafer having a first length, a first thickness, and a first width, said first thickness being a distance between a first surface and a second surface on said first piezoelectric wafer;

b1b) depositing a metallic layer on said first surface;

b1c) depositing another metallic layer on said second surface;

b1d) establishing a first polarity using a first poling voltage;

b1e) fabricating said second piezoelectric wafer having a second length, a second thickness, and a second width, said second thickness being a distance between a first surface and a second surface on said second piezoelectric wafer;

b1f) depositing a metallic layer on said first surface;

b1g) depositing another metallic layer on said second surface; and b1h) establishing a second polarity using a second poling voltage.

24. The method as recited in claim 23, wherein said step b1) further comprises the step of:

b1i) fabricating said stack by mating said first piezoelectric wafer to said second piezoelectric wafer so that said first polarity and said second polarity are aligned in the same direction.

25. The method as recited in claim 23, wherein said step b1) further comprises the step of:

b1i) fabricating said stack by mating said first piezoelectric wafer to said second piezoelectric wafer so that said first polarity and said second polarity are aligned in opposite directions.

26. The method as recited in claim 22, wherein said method further comprises the steps of:

d) establishing a first connection point for said piezoelectric actuator; and e) establishing a second connection point for said piezoelectric actuator, whereby when a positive voltage is applied from said first connection point to said second connection point, said first amount of capacitance increases, and when a negative voltage is applied from said first connection point to said second connection point, said first amount of capacitance decreases.

27. Customer premises equipment comprising:

a plurality of transmission line (T-line) arrays, wherein said plurality of T-line arrays comprises a plurality of antenna elements deposited on a first surface of said plurality of T-line arrays, at least one ground plane surface fabricated within at least one of said plurality of T-line arrays, a plurality of second plates deposited on a second surface of said plurality of T-line arrays, and a plurality of T-lines, wherein said plurality of antenna elements is coupled to said plurality of second plates using at least one of said plurality of T-lines;

a distribution network coupled to at least one of said plurality of T-line arrays;

a plurality of actuator arrays coupled to said plurality of T-line arrays, said plurality of actuator arrays comprising a plurality of first plates coupled to a plurality of piezoelectric actuators, said plurality of piezoelectric actuators being coupled to a plurality of reference surfaces, said plurality of first plates being coupled to said plurality of second plates using at least one dielectric material, wherein a first amount of capacitance is established between a first plate and a second plate, said first amount of capacitance causing a first amount of phase shift, wherein said plurality of antenna elements is configured into at least one I by J array, said plurality of first plates and said plurality of second plates are configured into at least one K by L array of voltage variable capacitors, wherein I, J, K, and L are positive integers, and wherein a voltage variable capacitor comprises at least one first plate, at least one second plate, and at least one piezoelectric actuator;

a transceiver coupled to said distribution network, said transceiver for processing signals received from at least one satellite using said at least one phased array antenna and for processing signals transmitted to said at least one satellite using said at least one phased array antenna; and a controller coupled to said at least one phased array antenna and to said transceiver, said controller for controlling said transceiver and for controlling said at least one phased array antenna, said controller providing at least one control signal to said at least one K by L array of voltage variable capacitors.

* * * * *